US007100579B2

(12) United States Patent
Kaneko et al.

(10) Patent No.: US 7,100,579 B2
(45) Date of Patent: Sep. 5, 2006

(54) FUEL INJECTION DEVICE

(75) Inventors: Takashi Kaneko, Sagamihara (JP); Hiroyuki Ishida, Nagasaki (JP); Kenichi Iwanaga, Nagasaki (JP); Takeshi Arai, Yokohama (JP); Shinji Yasueda, Yokohama (JP); Hiroshi Yoshizumi, Yokohama (JP); Akira Numata, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 189 days.

(21) Appl. No.: 10/332,501

(22) PCT Filed: Jul. 9, 2001

(86) PCT No.: PCT/JP01/05939

§ 371 (c)(1),
(2), (4) Date: Jul. 18, 2003

(87) PCT Pub. No.: WO02/04805

PCT Pub. Date: Jan. 17, 2002

(65) Prior Publication Data

US 2004/0025847 A1 Feb. 12, 2004

(30) Foreign Application Priority Data

Jul. 10, 2000 (JP) ..... 2000-207681
Oct. 20, 2000 (JP) ..... 2000-320227

(51) Int. Cl.
*F02M 37/04* (2006.01)

(52) U.S. Cl. ..... 123/506; 123/500

(58) Field of Classification Search ..... 123/500, 123/501, 506, 450, 467
See application file for complete search history.

(56) References Cited

U.S. PATENT DOCUMENTS

| | | | | |
|---|---|---|---|---|
| 4,326,672 | A * | 4/1982 | Goloff | 239/91 |
| 4,450,813 | A * | 5/1984 | Takano et al. | 123/450 |
| 4,712,528 | A * | 12/1987 | Schaffitz | 123/446 |
| 4,940,037 | A * | 7/1990 | Eckert | 123/506 |
| 4,974,564 | A | 12/1990 | Laufer | |
| 2002/0053340 | A1 * | 5/2002 | Lei | 123/446 |

FOREIGN PATENT DOCUMENTS

| | | |
|---|---|---|
| DE | 3863638 | 6/1988 |
| DE | 3863638 C | 6/1988 |
| DE | 3711744 | 10/1988 |
| DE | 3722264 A | 1/1989 |
| DE | 3877302 A | 2/1993 |
| DE | 3877302D | 2/1993 |
| EP | 309501 | 4/1989 |
| EP | 323984 | 7/1989 |

(Continued)

*Primary Examiner*—Carl S. Miller
(74) *Attorney, Agent, or Firm*—Wenderoth, Lind & Ponack, L.L.P.

(57) ABSTRACT

Fuel injection equipment is provided which realizes characteristics of fuel injection proper for all over the operation range of an engine, can further reduce nitrogen oxide(NOx) emission, and is high in mechanical durability. The fuel injection equipment for an internal combustion engine comprises an injection pump having a plunger part and a fuel passage equipped with a main electromagnetic valve, a fuel supply part for supplying the fuel to the fuel injection pump, a fuel injection pipe for sending the fuel to an injection nozzle part, and a secondary electromagnetic valve attached to an overflow pipe for returning to said fuel supply part the redundant fuel not to be injected from said unit injector, wherein an orifice is attached to said overflow pipe.

3 Claims, 13 Drawing Sheets

FOREIGN PATENT DOCUMENTS

| | | |
|---|---|---|
| JP | 1-502768 | 9/1989 |
| JP | 2-500207 | 1/1990 |
| JP | 6-101591 | 4/1994 |
| JP | 6-341357 | 12/1994 |
| JP | 11-198797 | 7/1999 |
| KR | 9613108 | 9/1996 |
| WO | 88/08080 | 10/1988 |
| WO | 89/00242 | 1/1989 |

* cited by examiner

Section A-A

Section B-B

Section C-C

Enlarged Portion D

FUEL INJECTION DEVICE

BACKGROUND OF THE INVENTION

1. Field of the Invention

The present invention relates to fuel injection equipment of an internal combustion engine, specifically of a diesel engine, which is devised to reduce the generation of nitrogen oxide(NOx) and at the same time to improve mechanical reliability.

2. Description of Related Art

In a diesel engine, the air sucked into the cylinder is compressed in the cylinder and fuel is injected into the compressed air of high pressure and high temperature in the form of spray to self ignite, and the piston is pushed down by the combustion pressure to generate power. It is absolutely necessary to equip the fuel injection equipment to inject the proper amount of fuel into the combustion chamber at proper injection timing.

The structure of conventional fuel injection equipment for injecting fuel into a diesel engine will be explained here with reference to FIG. 13. The drawing shows a fuel injection system using a unit injector 33 in which a fuel injection nozzle part for injecting fuel into the combustion chamber and a plunger part for supplying the highly pressurized fuel to the injection nozzle are integrated. As shown in the drawing, a fuel supply part 10 comprises a fuel tank 11, a fuel supply pump 12, and a volume chamber 13.

The fuel in the fuel tank 11 is pressurized and sent to the volume chamber 13 by the supply pump 12. The pressurized fuel temporarily resides in the volume chamber, then is sent to the plunger part 31 by way of the fuel passage 21 and main electromagnetic valve 41. The fuel is further pressurized in the plunger part 31 and is sent to the injection nozzle part 35 by way of the injection pipe 39 to be injected from the injection holes 38 into the combustion chamber. The redundant fuel not to be injected returns by passing through the injection pipe 39 and overflow pipe 22 by way of the check valve 43 and secondary electromagnetic valve 42 attached to the over flow pipe 22 to the fuel supply part 10. The modes of returning fuel will be described later.

The main electromagnetic valve 41 is attached to the fuel passage 21 to open and close the passage and the secondary electromagnetic valve 42 is attached to the overflow pipe 22 to open and close the pipe passage. The valves 41, 42 are direction control electromagnetic valves of the two-position normally open type, which have an opened position and a closed position. The check valve 43 permits the fuel to flow only from the injection pipe 39 side to the fuel supply part side 10. The opening/closing control operation of the electromagnetic valves 41 and 42 will be described later.

The unit injector 33 is composed of the plunger part 31 and injection nozzle part 35 integrated in an injector body (not shown in the drawing). The plunger part 31 and injection nozzle part 35 are located in series and they are communicated with each other by the fuel injection pipe 39 formed in the unit injector 33.

A roller 51 is attached to the plunger 32 of the plunger part 31. The roller 51 contacts with a cam 52. The cam 52 is driven by the output shaft (crankshaft) of the diesel engine. The plunger 32 reciprocates as the cam 52 rotates. Therefore, if the plunger 32 is lifted by the cam 52 when both the electromagnetic valves 41 and 42 are closed, the fuel compressed by the plunger 32 is sent through the injection pipe 39 to the injection nozzle part 35 from the nozzle 38.

A pressure spring 37 exerts a force on the fuel valve (nozzle needle) 36 in the injection nozzle part 35 to seat it on the nozzle seat. When the force by the pressure of the fuel sent from the plunger part 31 to lift the fuel valve 36 becomes higher than the force of the spring 37, the fuel valve 36 is pushed against the pressure spring 37 to be lifted and the fuel is injected into the combustion chamber in the cylinder in the form of fuel spray.

Next, the injection characteristics by such fuel injection equipment will be explained with reference to FIG. 14 which shows the change of the injection pressure and so on with time (crank angle). FIG. 14(*a*)~(*f*) each shows the following:

FIG. 14(*a*) . . . injection rate,

FIG. 14(*b*) . . . fuel valve lift,

FIG. 14(*c*) . . . fuel injection pressure,

FIG. 14(*d*) . . . lift of main electromagnetic valve,

FIG. 14(*e*) . . . lift of secondary electromagnetic valve, and

FIG. 14(*f*) . . . cam lift.

When the plunger 32 reaches a predetermined lift by the rotation of the cam 52, the main electromagnetic valve 41 is shifted from the open state to the closed state. The pressure of the fuel increases as the plunger 32 is lifted. A spring is incorporated in the check valve 43 attached to the overflow pipe 22, the check valve is opened when the force by the fuel pressure exceeds that of the spring, and the fuel returns to the fuel supply part 10. The fuel valve 36 is lifted more and more as the pressure of the fuel increases resulting in increased injection rate.

When the cam lift of the cam 52 increases further, the secondary electromagnetic valve 42 is shifted from the open state to the closed state. During the period from the perfect closing of the main electromagnetic valve 41 to the opening of the secondary electromagnetic valve 42, a part of the fuel returns through the overflow pipe 22 to the fuel supply part 10 side, so the fuel injection pressure is kept constant. According to the design, the pressure during this period is not constant, it may slightly increase or decrease, however, it is nearly flat.

As the fuel injection pressure during period T1 is flat, the injection rate during this period is suppressed as shown in FIG. 14(*a*).

When the secondary electromagnetic valve 42 is perfectly closed in the state the main electromagnetic valve 41 is perfectly closed, the fuel injection pressure increases from the flat state, thus the suppression of the injection rate is released and the injection rate increases.

Then, the main electromagnetic valve 41 and secondary electromagnetic valve 42 are shifted from the closed state to the opened state, the fuel injection pressure decreases, and the injection rate decreases to zero.

As the fuel injection rate in the initial part of the injection period, particularly during period T1, can be controlled by controlling opening/closing of the two electromagnetic valves 41 and 42, the fuel is not injected at a dash into the cylinder in the initial period, so the injection quantity in the initial period can be suppressed. As a result, rapid combustion of a large amount of fuel in the initial period of fuel injection is prevented, combustion temperature is suppressed to a low level, and the generation of nitrogen oxide(NOx) is reduced.

A check vale 43 is used in the prior art shown in FIG. 13 and FIG. 14. The check vale 43 comprises movable parts such as a spring and a valve, so mechanical failure has occurred often in use over a prolonged period, which reduces the reliability of the fuel injection equipment.

Further reduction in nitrogen oxide(NOx) by further suppressing the injection rate in the initial injection period is required. However, the prior art has not been able to address such a need.

BRIEF SUMMARY OF THE INVENTION

The present invention is directed to solving the problem of the prior art to provide fuel injection equipment which achieves proper fuel injection performance in all operation range of an engine, with which the emission of nitrogen oxide is further reduced, and which operates with high degree of mechanical reliability.

The invention relates to fuel injection equipment provided with a unit injector. In a first embodiment, fuel injection equipment is comprised of: a unit injector in which a plunger part and an injection nozzle part are incorporated into an integral unit, a fuel supply part for supplying fuel to the unit injector, a main electromagnetic valve attached to a fuel pipe or passage for sending the fuel to the unit injector, and a secondary electromagnetic valve attached to an overflow pipe or passage for returning to the fuel supply part the redundant fuel not to be injected from the unit injector. An orifice of variable opening area is attached to the overflow pipe or passage.

In one aspect of this embodiment, fuel injection equipment is comprised of a unit injector in which a plunger part and an injection nozzle part are incorporated into an integral unit, a fuel supply part for supplying fuel to the unit injector, a main electromagnetic valve attached to a fuel pipe or passage for sending the fuel to the unit injector, and a secondary electromagnetic valve attached to an overflow pipe or passage for returning to the fuel supply part the redundant fuel not to be injected from the unit injector. The secondary electromagnetic valve has a closed position, an open position, and a throttled open position.

In another aspect of this embodiment, fuel injection equipment is comprised of a unit injector in which a plunger part and an injection nozzle part are incorporated into an integral unit, a fuel supply part for supplying fuel to the unit injector, a main electromagnetic valve attached to a fuel pipe or passage for sending the fuel to the unit injector, and a secondary electromagnetic valve attached to an overflow pipe or passage for returning to the fuel supply part the redundant fuel not to be injected from the unit injector. The secondary electromagnetic valve has a closed position, a throttled open position, and an opened position.

In a second embodiment, fuel injection equipment is comprised of a separate type fuel injection pump and an injection nozzle part, both being connected with an injection pipe or passage. One aspect of this embodiment is fuel injection equipment comprising: a fuel injection pump having a plunger part, a fuel passage, and a main electromagnetic valve attached to the fuel passage; a fuel supply part for supplying the fuel to the fuel injection pump; a fuel injection pipe or passage for sending the fuel from the fuel injection pump to an injection nozzle part; and a secondary electromagnetic valve attached to an overflow pipe or passage for returning part to the fuel supply part the redundant fuel not to be injected from the injection nozzle part. An orifice of variable opening area is attached to the overflow pipe or passage.

In another aspect of the second embodiment, the fuel injection equipment comprises: a fuel injection pump having a plunger part, a fuel passage, and a main electromagnetic valve attached to the fuel passage; a fuel supply part for supplying the fuel to the fuel injection pump; a fuel injection pipe or passage for sending the fuel from the fuel injection pump to an injection nozzle part; and a secondary electromagnetic valve attached to an overflow pipe or passage for returning to the fuel supply part the redundant fuel not to be injected from the injection nozzle part. The secondary electromagnetic valve has a closed position, an open position, and a throttled position.

In another aspect of the second embodiment, the fuel injection equipment comprises: a fuel injection pump having a plunger part, a fuel passage, and a main electromagnetic valve attached to the fuel passage; a fuel supply part for supplying the fuel to the fuel injection pump; a fuel injection pipe or passage for sending the fuel from the fuel injection pump to an injection nozzle part; and a secondary electromagnetic valve attached to an overflow pipe or passage for returning to the fuel supply part the redundant fuel not to be injected from the unit injector. The secondary electromagnetic valve has a closed position, a throttled open position, and an opened position.

In the above embodiments, an orifice is attached to the overflow pipe or passage and main and secondary electromagnetic valves are controlled to be opened or closed. Therefore, the injection rate in the initial period of fuel injection can be reduced compared to the prior art, the fuel is not injected rapidly into the cylinder, and injection quantity in the initial period can be reduced compared to the prior art. As a result, rapid combustion of a large amount of fuel in the initial period of fuel injection is prevented, combustion temperature is reduced to a lower level, and the generation of nitrogen oxide(NOx) is further reduced.

As the orifice has no movable parts, mechanical failure does not occur in use over a prolonged period, and higher reliability of the fuel injection equipment is attained compared with the check valve of the prior art.

As the orifice is of a variable opening area, the quantity of the fuel returning through the overflow pipe or passage can be adjusted optimally.

According to the present invention, the orifice is located upstream from the secondary electromagnetic valve on the overflow pipe or passage in regard to the flow direction of the fuel returning from the unit injector, or the orifice is located downstream from the secondary electromagnetic valve on the overflow pipe or passage in regard to the flow direction of the fuel returning from the unit injector. Thus, an arrangement optimal for the fuel injection equipment can be arbitrarily selected.

By composing the fuel injection equipment as in the previous embodiments, the secondary electromagnetic valve has a closed position and a throttled open position, or has a closed position and a throttled open position and an opened position. In that case, the electromagnetic valve effects throttling function and the orifice is not necessary, which contributes to simple fuel injection equipment.

A third embodiment can be applied to both types of fuel injection equipment, the equipment provided with a unit injector and that provided with a separate type fuel injection pump. One aspect of this embodiment is fuel injection equipment comprising: a plunger part having a plunger for pressurizing the fuel supplied from a fuel supply part; an injection nozzle part for injecting the highly pressurized fuel sent from the plunger part through the injection pipe or passage to the combustion chamber of an internal combustion engine; two fuel passages arranged in parallel connection between the fuel supply part and fuel injection pipe or passage; and two electromagnetic valves, each being attached to each of the two fuel passages to open or close the fuel passages. A first and second orifice, are attached to each of the two fuel passages to throttle the flow area thereof, and an orifice switching apparatus for selecting the action of the first orifice or second orifice.

Another aspect of the third embodiment is fuel injection equipment as described above, which is further comprised of; a rotation speed detector for detecting the rotation speed of the internal combustion engine, a load detector for detecting the engine load or output, and an orifice control apparatus which judges whether or not the action of the first orifice or second orifice is necessary based on the detected signals of engine rotation speed and load or output, and outputs the result to the orifice switching apparatus.

Another aspect of the third embodiment is fuel injection equipment as described above, wherein the first and second orifices are formed to have different throttled flow areas relative to each other.

Another aspect of the third embodiment is fuel injection equipment as described above, wherein the throttled flow area of each of the first orifice and second orifice is variable.

According to the third embodiment, the injection pressure rises more gently in the high speed range of engine operation by allowing the orifice of larger flow area to work through the orifice control apparatus.

By this, rapid combustion in the high speed range (or high load range) is reduced, excessive elevation of the maximum pressure and combustion temperature in the cylinder is prevented, resulting in the improved endurance of the components around the combustion chamber and reduction in nitrogen oxide(NOx) emission.

In the low speed or low load range of the engine, the reduction in the injection pressure in the initial period is prevented by selecting the orifice of smaller throttled flow area or reducing the throttled flow area of the orifice to reduce the returning fuel according to the fuel quantity sent out from the plunger part in the initial period of the fuel injection, and a proper injection pressure mode can be attained.

By this, the occurrence of failed combustion due to reduced injection pressure in the low speed or low load range of the engine is prevented, and the deterioration in exhaust smoke and increase in fuel consumption are prevented.

DETAILED DESCRIPTION OF THE INVENTION

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only, not as limitative of the scope of the present invention.

Figure 1:
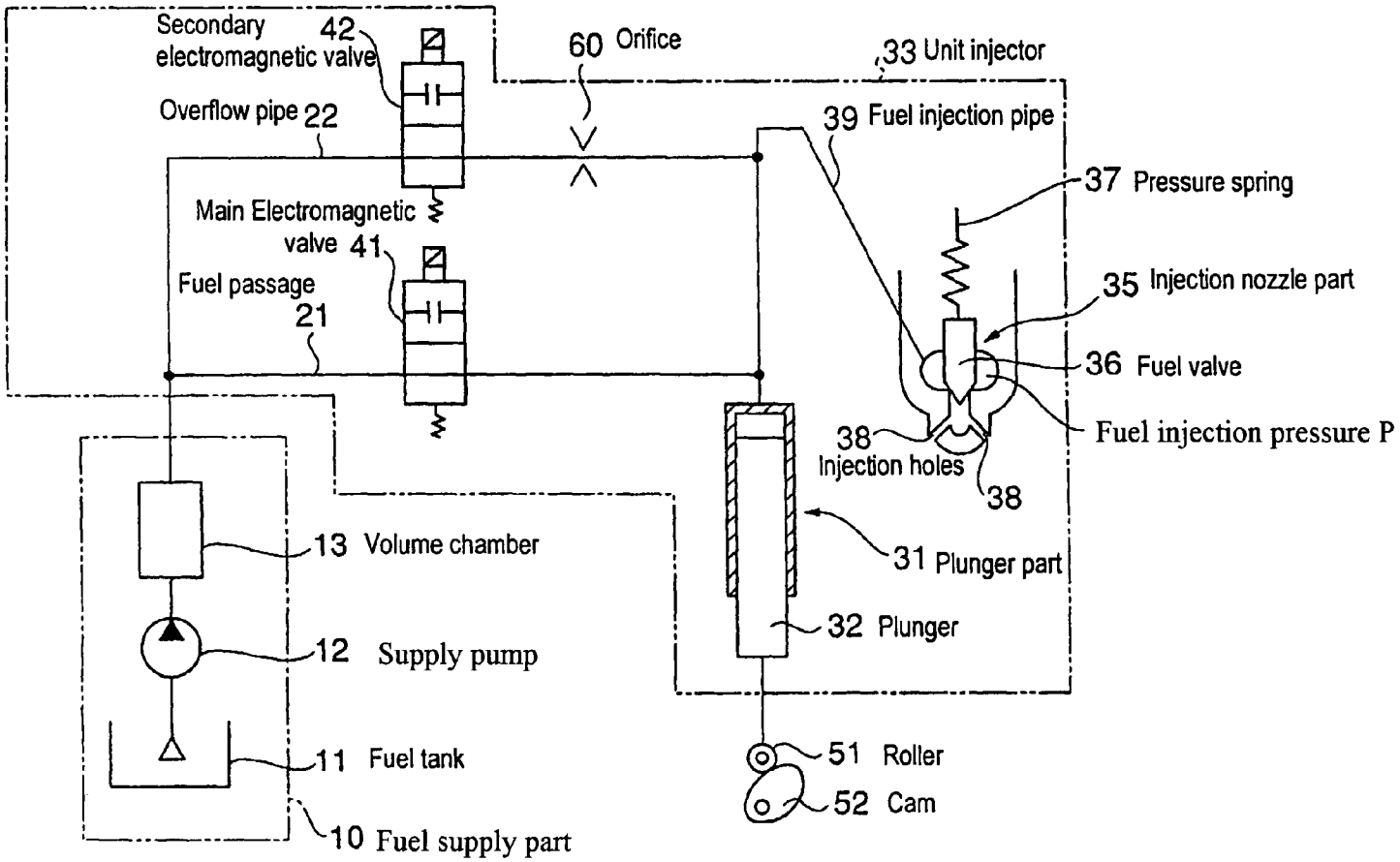
FIG. 1 is a system diagram of the fuel injection equipment for a diesel engine of the first embodiment according to the present invention.

FIG. 1 is a system diagram of the fuel injection equipment for a unit injector of the first embodiment according to the present invention. In the drawing, reference numeral 10 is a fuel supply part, 33 is a unit injector composed of an injection nozzle part 35 and a plunger part 31 for compressing fuel and supplying the highly pressurized fuel to the injection nozzle part 35 integrated into a unit.

The fuel supply part 10 is composed of a fuel tank 11, a supply pump 12, and a volume chamber 13. The fuel in the fuel tank 11 is pressurized and supplied by the supply pump 12 to the volume chamber 13. The pressurized fuel temporarily resides in the volume chamber 13, then is sent to the plunger part 31 by way of the fuel passage 21 and main electromagnetic valve 41. The fuel is further pressurized in the plunger part 31 and is then sent through the injection pipe or passage 39 to the injection nozzle part 35 to be injected from the injection holes 38 into the combustion chamber. The redundant fuel not to be injected, along with the fuel leaked from the unit injector 33, returns to the fuel supply part 10 by passing through the injection pipe or passage 39 and overflow pipe or passage 22 by way of the check valve 43 and secondary electromagnetic valve 42.

The main electromagnetic valve 41 is attached to the fuel passage 21 for opening/closing the passage, and the secondary electromagnetic valve 42 is attached to the overflow pipe or passage 22. The valves 41, 42 are direction control electromagnetic valves of the two-position normally open type, which have an opened position and closed position. The check valve 43 permits the fuel to flow only from the injection pipe or passage 39 side to the fuel supply part side.

The unit injector 33 is composed of the plunger part 31 and injection nozzle part 35 integrated in a injector body (not shown in the drawing). The plunger part 31 and injection nozzle part 35 are located in series in the injector body and they are communicated with each other by way of the fuel injection pipe or passage 39 formed in the unit injector 33.

A roller 51 is attached to the plunger 32 of the plunger part 31. The roller 51 contacts with a cam 52. The cam 52 is driven by the output shaft (crankshaft) of the diesel engine, causing the cam 52 to rotate. The plunger 32 reciprocates as the cam 52 rotates. Therefore, if the plunger 32 is lifted up when both said electromagnetic valves 41, 42 are closed, the fuel compressed by the plunger 32 is sent through the injection pipe or passage 39 to the injection nozzle part 35.

A pressure spring 37 exerts a force on the fuel valve (nozzle needle) 36 in the injection nozzle part 35 to seat it on the nozzle seat. When the force by the pressure of the fuel sent from the plunger part 31 to lift the fuel valve 36 becomes higher than the force of the spring 37, the fuel valve 36 is pushed against the pressure spring 37 to be lifted and the fuel is injected into the combustion chamber in the cylinder in the form of fuel spray.

The structure described above is the same as that of the conventional art. Improvements are made in the present invention to the part of the fuel passage 21 to which the main electromagnetic valve 41 is attached, and to the part of the fuel return pipe or passage (overflow pipe or passage 22) to which the secondary electromagnetic valve 42 is attached.

As shown in FIG. 1 which shows a first embodiment, an orifice 60*a* of variable opening area is attached to said overflow pipe or passage 22 between the secondary electromagnetic valve 42 and the injection pipe or passage 39 of the unit injector 33. That is, the orifice 60*a* of variable opening area is provided instead of the check valve 43 in FIG. 13 of the prior art.

When the main electromagnetic valve 41 is closed and secondary electromagnetic valve 42 is open, the action and effect when the plunger 32 is lifted to raise the fuel pressure differs depending on whether the orifice 60*a* of variable opening area is provided or the check valve 43 of the prior art is provided on the overflow pipe or passage 22 as follows:

In the case with the orifice 60*a*, the fuel in the injection pipe or passage 39 side is returned through the overflow pipe or passage 22 to the secondary electromagnetic valve 42 and to the fuel supply part 10 as soon as the fuel pressure rises. In the case with the check valve 43 of the prior art, the fuel does not start returning until after the force by the fuel pressure exceeds the force exerted by the spring of the check valve 43. Therefore, the timing of fuel return is different in both cases.

Figures 2A, 2B, 2C, 2D, 2E, 2F:
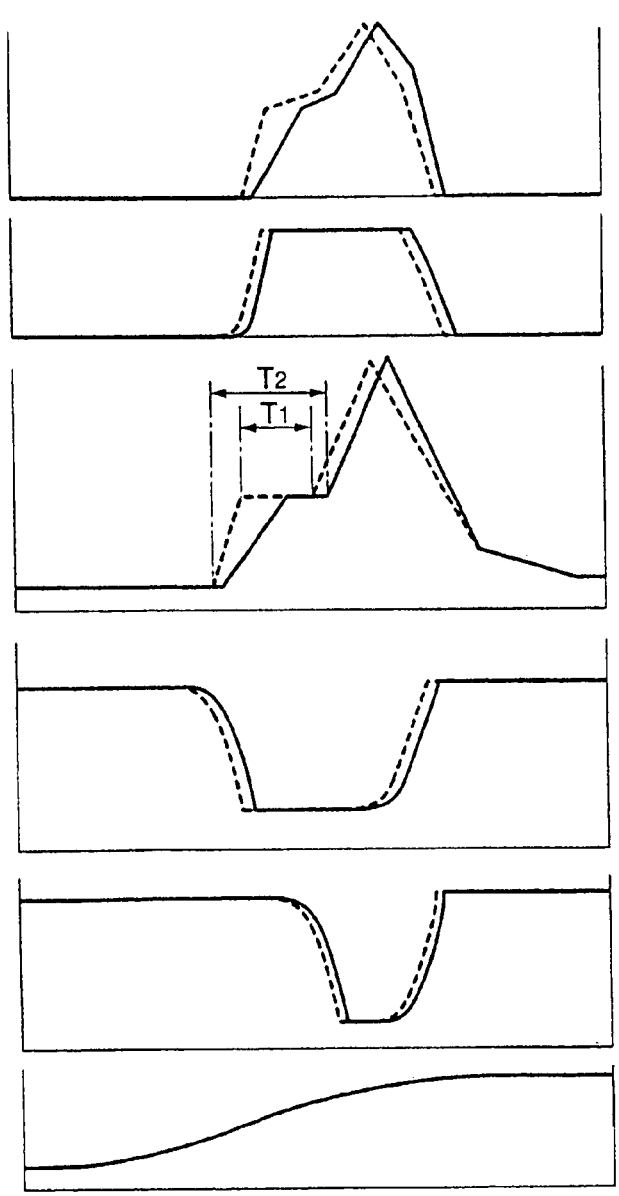
FIG. 2 is a representation showing the injection characteristics of the fuel injection equipment according to the present invention compared with that of prior art.
Figure 3A:
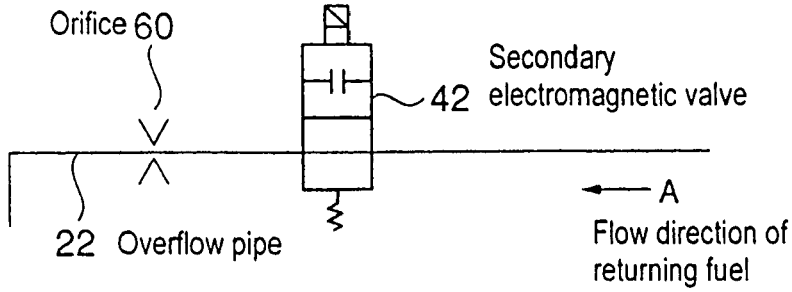
FIG. 3 is block diagrams, each diagram showing the arrangement of the orifice and electromagnetic valve in the overflow line of each embodiment.
Figure 3B:
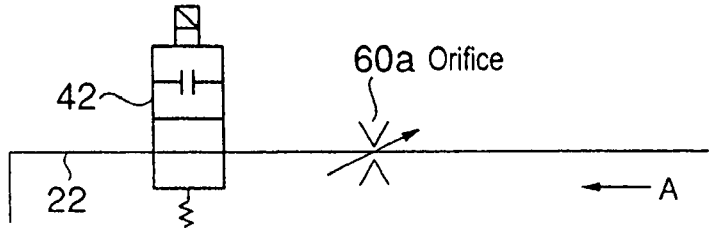
Figure 3C:
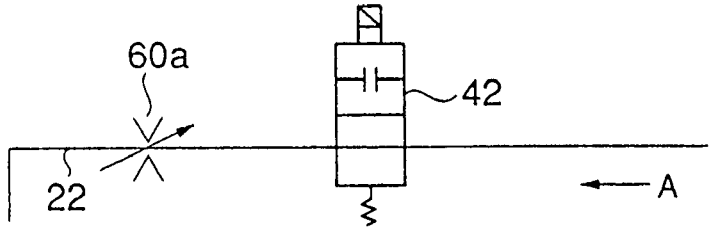
Figure 3D:
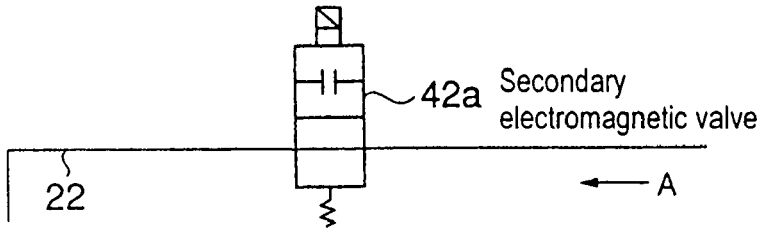
Figure 3E:
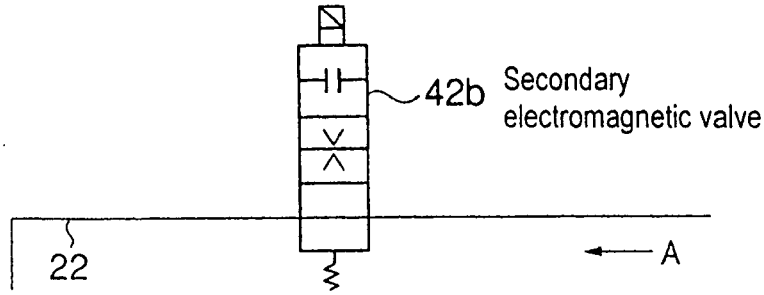

As the timing of fuel return is different between the case of the present embodiment and prior art, the action and effect during the injection period is also different. The action timing in the case of the embodiment will be explained with reference to FIG. 2. FIG. 2(*a*)~(*f*) each shows the following:

FIG. 2(*a*) . . . injection rate,

FIG. 2(*b*) . . . fuel valve lift,

FIG. 2(*c*) . . . fuel injection pressure,

FIG. 2(*d*) . . . lift of main electromagnetic valve,

FIG. 2(*e*) . . . lift of secondary electromagnetic valve, and

FIG. 2(*f*) . . . cam lift.

In FIG. 2, solid lines indicate the case of the present embodiment, and broken lines indicate the case of the prior art.

When the plunger 32 reaches a predetermined lift by the rotation of the cam 52, the main electromagnetic valve 41 is shifted from the opened state to the closed state. The pressure of the fuel increases as the plunger 32 is lifted. The fuel returns to the fuel supply part 10 passing through the orifice 60*a* of variable opening area and secondary electromagnetic valve 42 attached to the overflow pipe or passage 22 as soon as the fuel pressure rises. On the other hand, the fuel valve 36 is lifted more and more as the pressure of the fuel increases resulting in increased injection rate.

When the plunger lift increases further, the secondary electromagnetic valve 42 is shifted from the opened state to the closed state. During period T2 from the time point when the main electromagnetic valve 41 begins to shift from opened state toward closed state until that when the secondary electromagnetic valve 42 is perfectly closed, the fuel returns to the fuel supply part 10 through the overflow pipe or passage 22, as the orifice 60*a* of variable opening area and secondary electromagnetic valve 42 are open. Therefore, the injection pressure is more suppressed compared with the characteristic (broken line) in the case of the prior art, as shown in FIG. 2(*c*).

The period T2 during which the fuel injection pressure is suppressed in the embodiment is longer than T1 during which the fuel injection pressure is suppressed in the case of the prior art, and also the injection rate begins to rise earlier with the embodiment than with the prior art as the return of fuel through the orifice 60*a* of variable opening area begins as soon as the fuel compression by the plunger 32 begins.

As the fuel injection pressure during initial period T2 is more suppressed compared with that in the case with the prior art, the fuel injection rate during period T2 is further depressed than the characteristic (broken line) in the case of the prior art, as shown in FIG. 2(*a*).

When the secondary electromagnetic valve 42 is perfectly closed in the state the main electromagnetic valve 41 is perfectly closed, the fuel injection pressure increases from the flat state, thus the suppression of the injection rate is released and the injection rate increases.

The main electromagnetic valve 41 and secondary electromagnetic valve 42 are then shifted from the closed state to the opened state, the fuel injection pressure decreases, and the injection rate decreases to zero.

As described above, according to the embodiment, the orifice 60*a* of variable opening area is attached to the overflow pipe or passage 22 and the electromagnetic valves 41 and 42 are controllable to be opened or closed. As a result, the injection rate in the initial part of the fuel injection period, specifically in period T2, can be further suppressed compared with the case of the prior art. Also, the fuel is not injected at a dash into the cylinder and the injection quantity in the initial period can be reduced compared to the case of the prior art. As a result, rapid combustion of a large amount of fuel in the initial period of fuel injection is prevented, combustion temperature is reduced to a lower level, and the generation of nitrogen oxide(NOx) is reduced.

The orifice 60*a* of variable opening area has no movable parts, so mechanical failure does not occur in use over a prolonged period and high reliability of the fuel injection equipment is attained.

Next, examples of the arrangement of the orifice and electromagnetic valve in the overflow pipe or passage, which is the important part of the present invention, will be explained with reference to FIG. 3(*b*)~FIG. 3(*e*).

In the examples of FIG. 3(*b*), (*c*), a secondary electromagnetic valve 42 and an orifice 60*a* of variable opening area are attached to the overflow pipe or passage 22. In FIG. 3(*b*), the orifice 60*a* of variable opening area is located upstream from the secondary electromagnetic valve 42, and in FIG. 3(*c*), the orifice 60*a* of variable opening area is located downstream from the secondary electromagnetic valve 42.

In the example shown in FIG. 3(*d*), only a secondary electromagnetic valve 42*a* is attached to the overflow pipe or passage 22. The opening(opening area) at the opened position of this secondary electromagnetic valve 42*a* is throttled to about the same as that of the orifice 60*a*.

In the example shown in FIG. 3(*e*), a 3-position type secondary electromagnetic valve 42*b* is attached to the overflow pipe or passage 22. This secondary electromagnetic valve 42*b* has the opened position, a throttled open position, and the closed position, the opening(opening area) of the throttled position being about the same as that of the orifice 60*a*.

Therefore, the throttled open position is inevitably passed when shifting from the opened position to the closed position, and the similar work as the other embodiment is effected. As a result, the suppression of the fuel injection rate in the initial part of the fuel injection period is possible.

Figure 4:
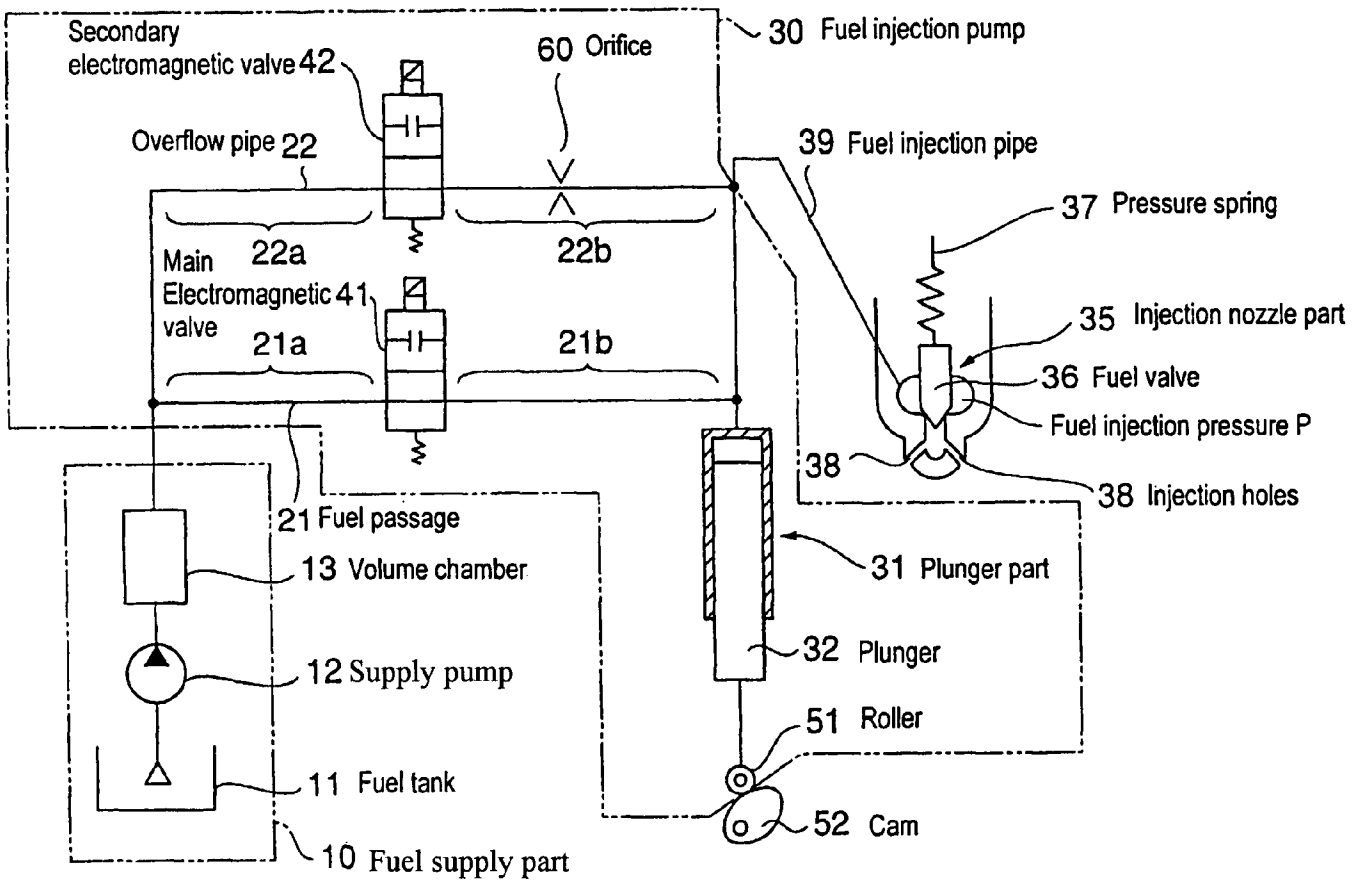
FIG. 4 is a system diagram of the fuel injection equipment for a diesel engine of the second embodiment according to the present invention.

FIG. 4 is a system diagram of the fuel injection equipment of the second embodiment according to the present invention. In this embodiment, the equipment is provided with a separate type fuel injection pump and a separate injection nozzle part connected with an injection pipe or passage. In the drawing, reference numeral 30 is a fuel injection pump, 31 is a plunger part of the fuel injection pump 30, 35 is a nozzle part, and 39 is an injection pipe or passage connecting the fuel outlet of the plunger part and the injection nozzle part 35.

In the second embodiment, a secondary electromagnetic valve 42 and an orifice 60*a* of variable opening area are attached to an overflow pipe or passage 22 of the separate type fuel injection pump. Said orifice 60*a* of variable opening area is provided instead of the check valve 43 in the prior art of FIG. 1.

Figure 5:
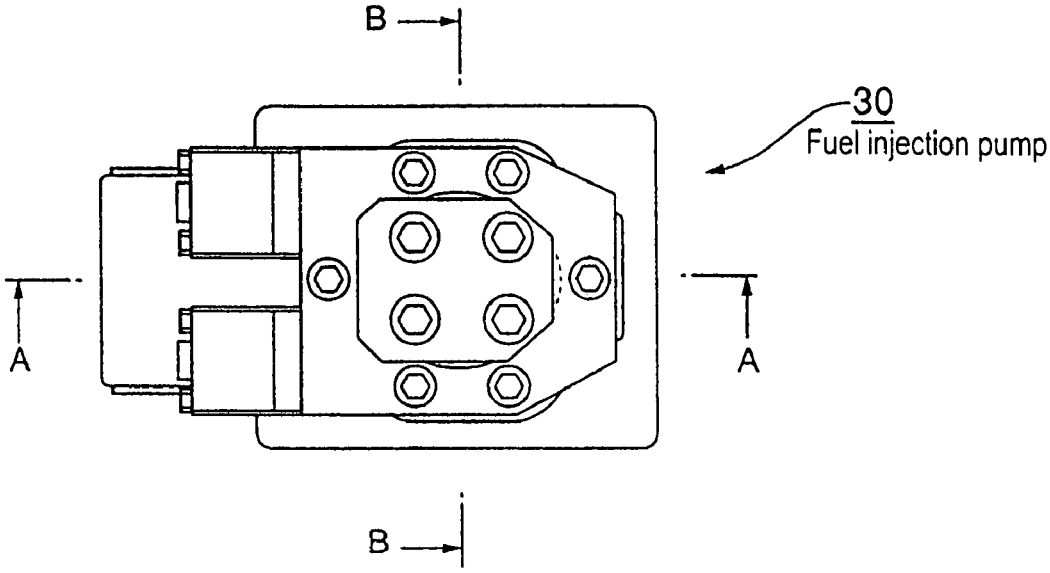
FIG. 5 is a plan view of the fuel injection pump of the second embodiment.
Figure 6:
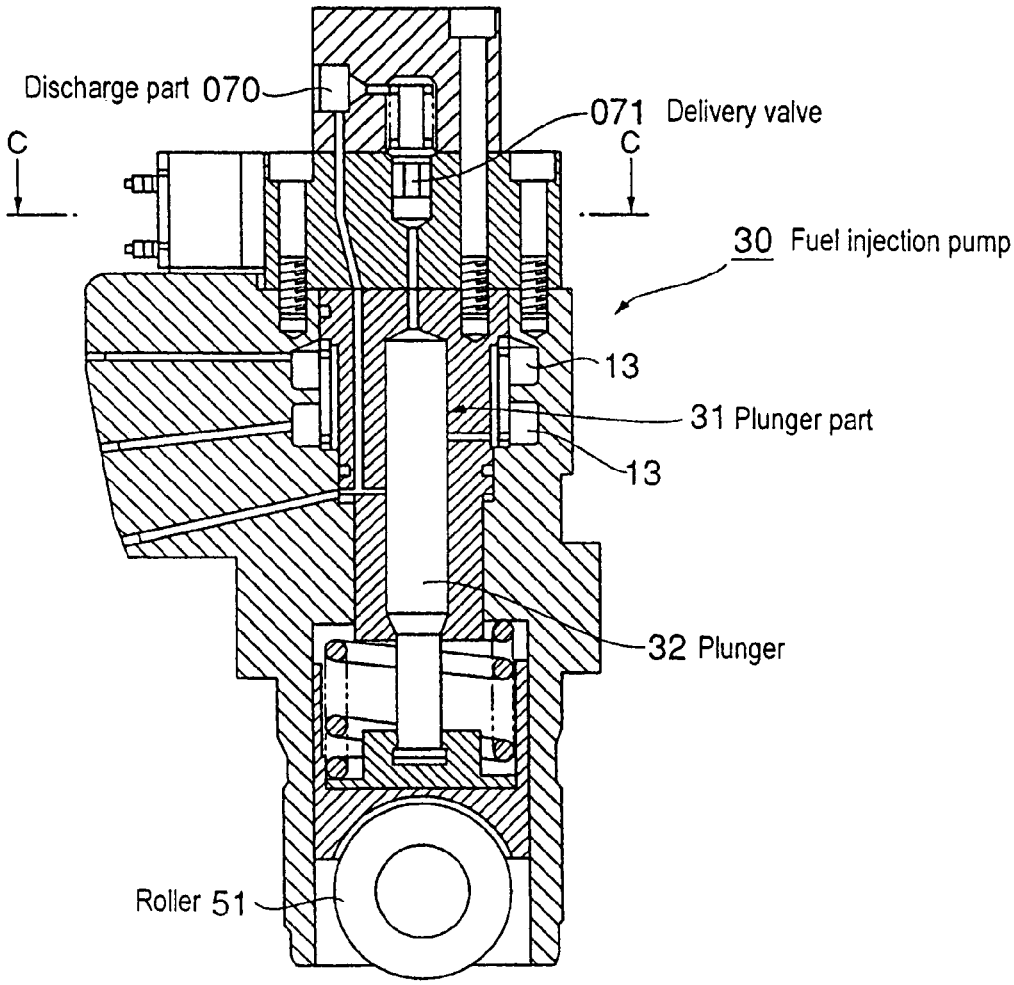
FIG. 6 is a longitudinal sectional view (section A—A in FIG. 5) of the fuel injection pump of the second embodiment.
Figure 7:
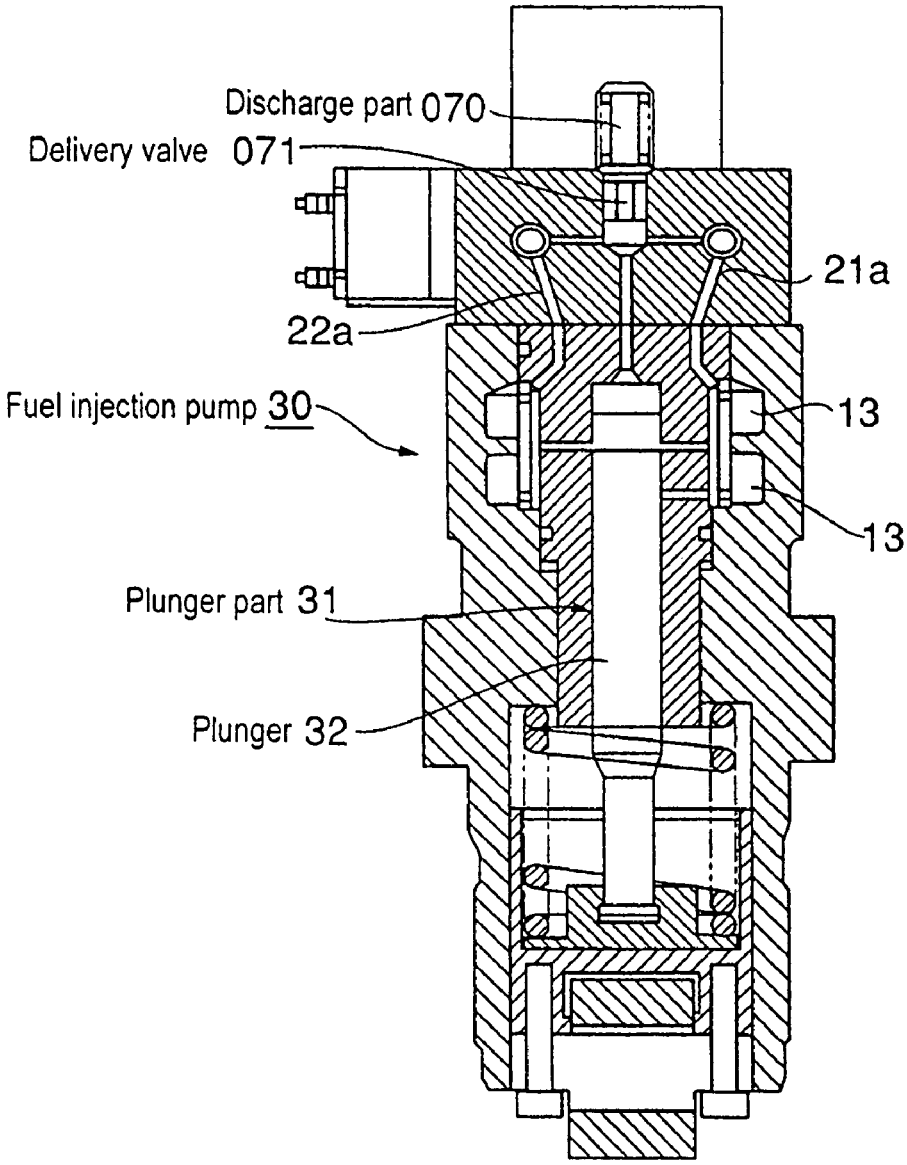
FIG. 7 is a longitudinal sectional view (section B—B in FIG. 5) of the fuel injection pump of the second embodiment.
Figure 8:
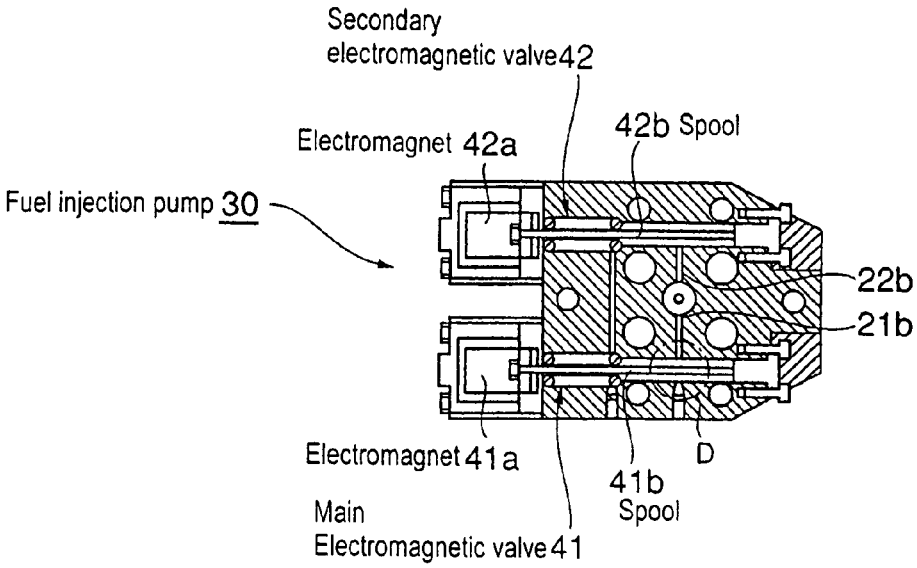
FIG. 8 is a sectional view along line C—C in FIG. 6.
Figure 9:
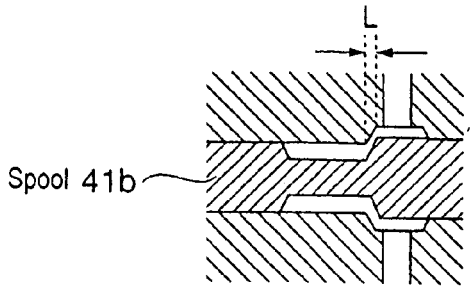
FIG. 9 is an enlarged partially sectional view of portion D in FIG. 8.

The structure of the fuel injection pump 30 of the second embodiment to which the electromagnetic valves are attached is shown in FIG. 5~FIG. 9. FIG. 5 is a plan view of the fuel injection pump, FIG. 6 is a longitudinal sectional view along line A—A in FIG. 5, FIG. 7 is a longitudinal sectional view along line B—B in FIG. 5, FIG. 8 is a cross sectional view along line C—C in FIG. 6, and FIG. 9 is an enlarged detail of part D in FIG. 8. In these drawings, the fuel passage 21 is divided in a passage 21*a* and 21*b* between which the main electromagnetic valve 41 is installed, and the overflow pipe or passage 22 is divided in a pipe or passage 22*a* and 22*b* (actually these pipes are formed as passages in the pump) between which the secondary electromagnetic valve 42 and orifice 60*a* of variable opening area are installed.

Specifically, (1) the passage 21*a* is the part of the fuel passage 21 connecting the main electromagnetic valve 41 to the fuel supply part 10, (2) the passage 21*b* is the part of the fuel passage 21 connecting the main electromagnetic valve 41 to the plunger part 31, (3) the pipe 22*a* is the part of the overflow pipe or passage 22 connecting the secondary electromagnetic valve 42 to the fuel supply part 10, and (4) the pipe or passage 22*b* is the part of the overflow pipe or passage 22 connecting the secondary electromagnetic valve 42 to the plunger part 31.

The main electromagnetic valve 41 and secondary electromagnetic valve 42 are provided horizontally parallel at the top part of the plunger part 31 as shown in FIG. 8. The main electromagnetic valve 41 comprises an electromagnet 41*a* and a spool 41*b*, and the secondary electromagnetic valve 42 comprises an electromagnet 42*a* and a spool 42*b* as main components. Said spools 41*b* and 42*b* maybe of the same diameter. The lift of each electromagnetic valves 41 and 42 is determined according to an injection rate target, however, when electromagnetic valves of the same spool diameter are used, the lift of the secondary electromagnetic valve 42 is determined to be smaller than that of the main electromagnetic valve 41.

It may be acceptable to determine the same lift L (shown in FIG. 9) for both valves 41, 42 and each spool diameter is determined according to an injection rate target. When electromagnetic valves of the same lift diameter are used, the spool diameter of the secondary electromagnetic valve 42 is determined to be smaller than that of the main electromagnetic valve 41.

As shown in FIG. 6 and FIG. 7, a discharge part 070 is formed at the top part of said injection pump 30. Said injection pipe or passage 39 is connected to the discharge part 070. A delivery valve 071 is provided between the discharge part 070 and plunger part 31. The fuel supplied to the injection nozzle part 35 is sent through the route of plunger part 31→delivery valve 071→discharge part 070→fuel injection pipe or passage 39→injection nozzle part 35.

Figure 10:
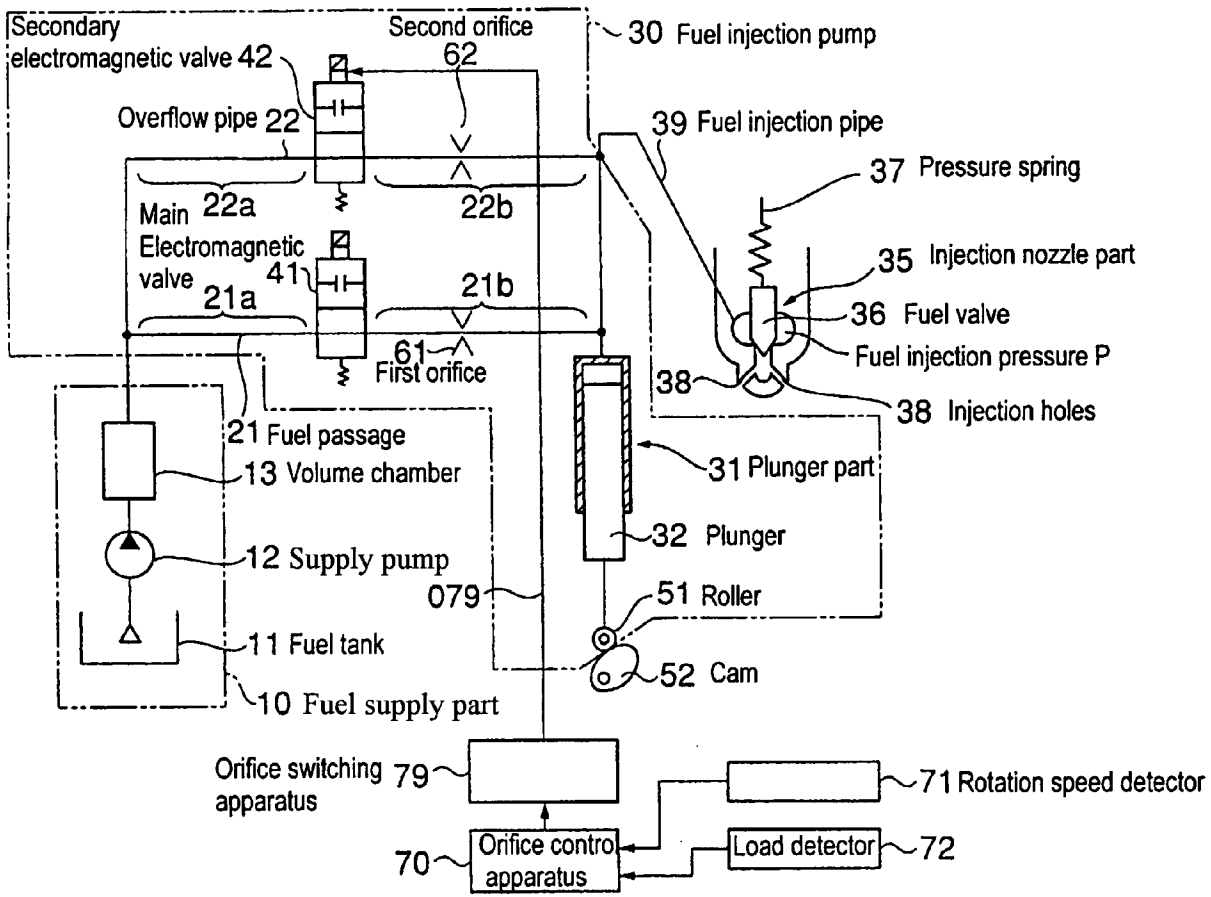
FIG. 10 is a system diagram of the fuel injection equipment for a diesel engine of the third embodiment according to the present invention.
Figure 11:
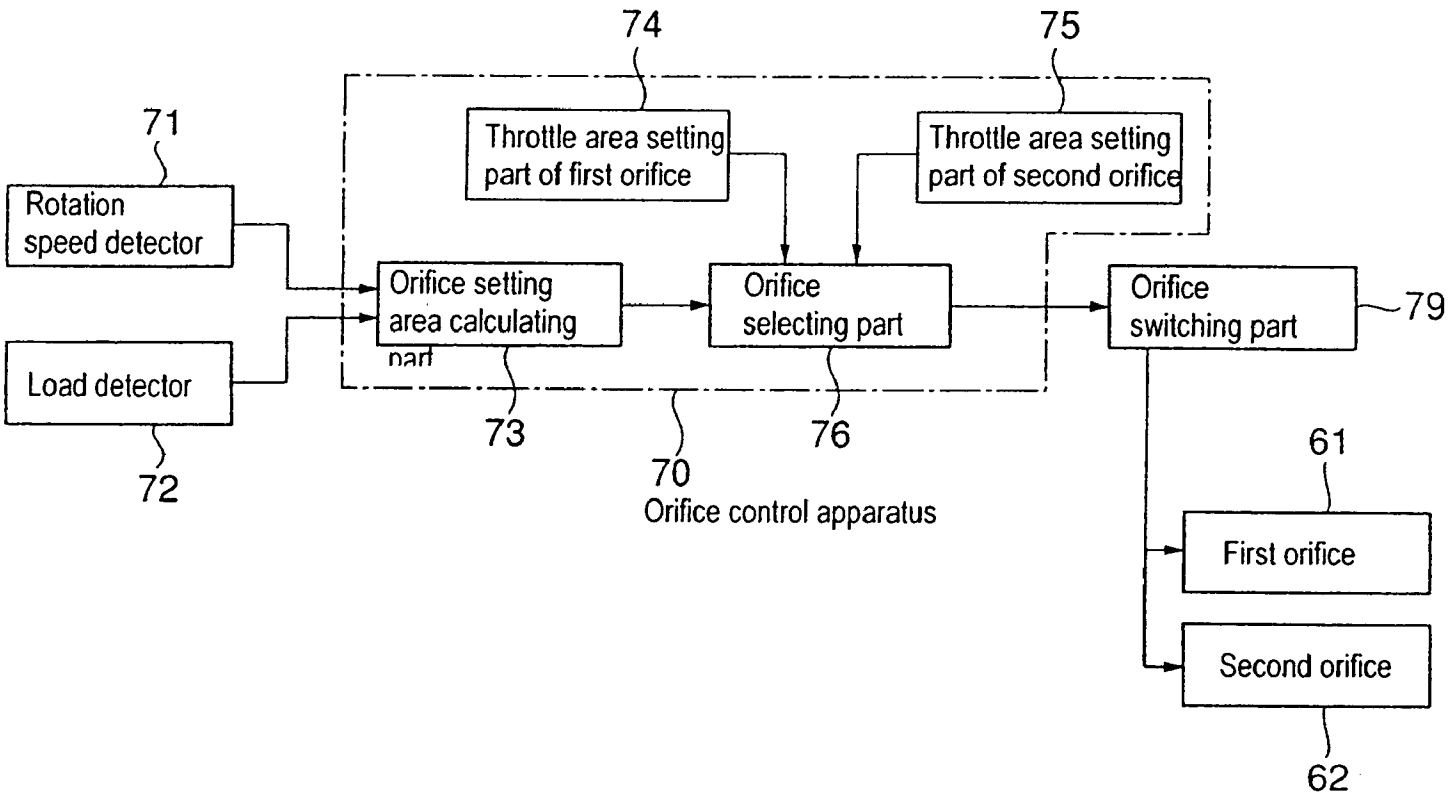
FIG. 11 is a control block diagram of controlling the first and second orifices.
Figure 12:
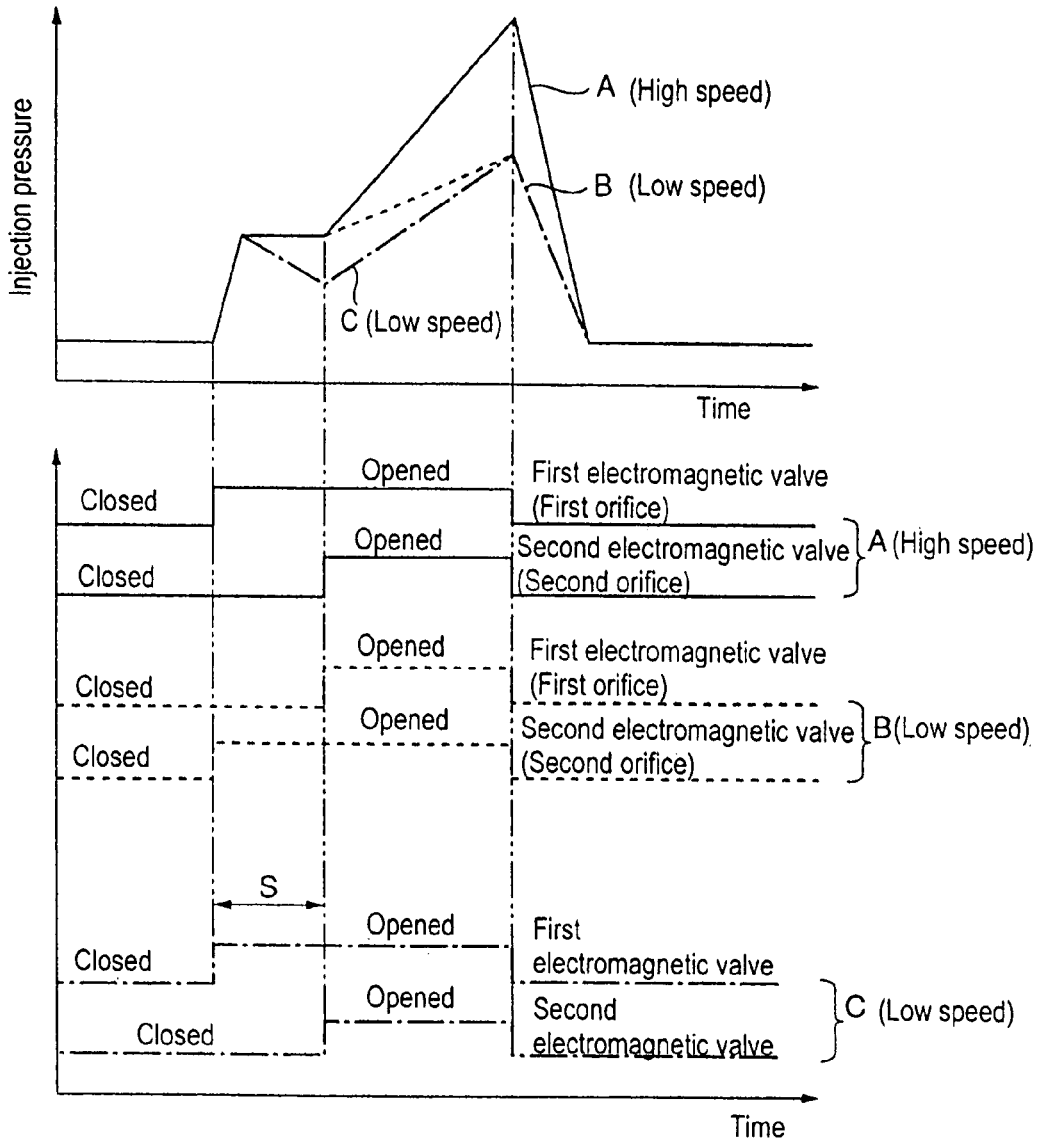
FIG. 12 is a diagram showing injection pressure and switching timing of orifices.

The third embodiment is shown in FIG. 10~FIG. 12. FIG. 10 is a system diagram of the fuel injection equipment of the third embodiment, FIG. 11 is a control block diagram of the first and second orifice, and FIG. 12 is a diagram showing injection pressure and switching timing of the orifices.

In this embodiment, the fuel injection equipment is composed of a separate fuel injection pump and a separate injection nozzle part as is the case with the second embodiment. In the drawing, reference numeral 30 is a fuel injection pump, 31 is a plunger part of the fuel injection pump 30, 35 is a nozzle part, and 39 is an injection pipe or passage connecting the fuel outlet of the plunger part and said injection nozzle part.

A roller 51 is attached to the plunger 32 of the plunger part 31. The roller 51 contacts with a cam 52. The cam 52 is driven to rotate by the output shaft (crank shaft) of the diesel engine, and the plunger 32 is reciprocated according as the cam 52 rotates.

Reference numeral 10 is a fuel supply part. The fuel supply part 10 is composed of a fuel tank 11, a supply pump 12, and a volume chamber 13. The fuel in the fuel tank 11 is pressurized and sent to the volume chamber 13 by the supply pump 12 and temporarily resides in the volume chamber 13 to be sent out therefrom.

Reference numeral 21 is a fuel passage connecting the fuel supply part 10 and fuel injection pipe or passage 39. Reference numeral 22 is an overflow pipe or passage which connects the fuel supply part 10 to the fuel injection pipe or passage 39 with the fuel injection pipe or passage 39 downstream from the connection point of the fuel passage 21.

A main electromagnetic valve 41 is attached to the fuel passage 21 to open and close the passage, and a secondary electromagnetic valve 42 is attached to the overflow pipe or passage 22 to open and close the passage. In FIG. 10, the fuel passage which the main electromagnetic valve 41 is attached to is separated into two sections as are indicated by reference numeral 21*a* and 21*b*, and the overflow pipe or passage 22 to which the secondary electromagnetic valve 42 is attached is separated into two sections as are be indicated by reference numeral 22*a* and 22*b*.

The main electromagnetic valve 41 and secondary electromagnetic valve 42 are direction control electromagnetic valves of the two-position normally open type, which have an opened position and a closed position.

Therefore, if the plunger 32 of the plunger part 31 is lifted by the cam 52 when both the electromagnetic valves 41, 42 are closed, the fuel compressed by the plunger 32 is sent through the injection pipe or passage 39 to the injection nozzle part 35.

A pressure spring 37 exerts a force on the fuel valve (nozzle needle) 36 in the injection nozzle part 35 to seat it on the nozzle seat. When the force by pressure of the fuel sent from the plunger part 31 to lift the fuel valve 36 becomes higher than the force of the spring 37, the fuel valve 36 is lifted and the fuel is injected into the combustion chamber in the cylinder in the form of fuel spray.

The structure described above is the same as that of the second embodiment. In the third embodiment, a first orifice 61 and a second orifice 62 are attached to the fuel passage 21 and overflow pipe or passage 22 respectively.

In FIG. 10, reference numeral 61 is the first orifice attached to the fuel passage 21*b* between the main electromagnetic valves 41 and fuel injection pipe or passage 39. Reference numeral 62 is the second orifice attached to the overflow pipe or passage 22*b* between the secondary electromagnetic valves 42 and fuel injection pipe or passage 39.

The orifice 61 maybe attached to the fuel passage 21*a* between the main electromagnetic valves 41 and fuel supply part 10, and the orifice 62 may be attached to the overflow pipe or passage 22*a* between the secondary electromagnetic valves 42 and fuel supply part 10.

Further, it is suitable that said main electromagnetic valve 41 and secondary electromagnetic valve 42 are composed such that each valve is of the 3-posistion type having a throttled open position and the first orifice 61 is integrated in the main electromagnetic valve 41, and the second orifice 62 is integrated in the second electromagnetic valve 42 as shown in FIG. 3(*e*).

The first orifice 61 is attached to the fuel passage 21 together with the main electromagnetic valve 41. The second orifice 62 is attached to the overflow pipe or passage 22 together with the second electromagnetic valve 42. The first and second orifices 61 and 62 have a fixed throttle area, but have different throttle areas with respect to each other.

Reference numeral 79 is an orifice switching apparatus, and 70 is an orifice control apparatus. A switching control signal as described later is sent to the orifice switching apparatus 79 from the orifice control apparatus 70. Switching signals are sent from the orifice switching apparatus 79 on a wire 079 to the main electromagnetic valve 41 attached together with said first orifice 61 and second electromagnetic valve 42 attached together with said second orifice 62 to open or close them respectively, by which the action of the first and second orifice are switched. That is, the opened electromagnetic valve means the action of the orifice provided together with the valve and closed electromagnetic valve means no-action of the orifice provided together with the valve.

Reference numeral 71 is a rotation speed detector for detecting the engine rotation speed of the diesel engine, and 72 is a load detector for detecting the engine load(or output).

The detected signals from the rotation speed detector 71 and the load detector 72 are input to the orifice control apparatus 70.

Transitions of cylinder pressure, etc. in the operation of the diesel engine equipped with the fuel injection equipment of the embodiment are shown in FIG. 2, in which FIG. 2(*a*) shows the transition of injection rate, FIG. 2(*b*) shows that of fuel valve lift, FIG. 2(*c*) shows that of fuel injection pressure, FIG. 2(*d*) shows that of the lift of main electromagnetic valve, FIG. 2(*e*) shows that of the lift of secondary electromagnetic valve, and FIG. 2(*f*) shows that of cam lift.

In FIG. 2, solid lines indicate the case with the embodiment, and broken lines indicate the case of the prior art.

When the plunger 32 reaches a predetermined lift by the rotation of the cam 52, the main electromagnetic valve 41 is shifted from the opened state to the closed state.

The pressure of the fuel increases as the plunger 32 is lifted, as shown in FIG. 2(*c*). The fuel returns to the fuel supply part 10 passing through the orifice 60 and secondary electromagnetic valve 42 attached to the overflow pipe or passage 22 as soon as the fuel pressure rises. At the same time, the fuel valve 36 is lifted more and more as the pressure of the fuel increases resulting in increased injection rate. When the plunger lift increases further, the secondary electromagnetic valve 42 is shifted from the opened state to the closed state. During period T2 from the time point when the main electromagnetic valve 41 begins to shift from opened state toward closed state until that when the secondary electromagnetic valve 42 is perfect closed, the fuel returns to the fuel supply part 10 through the overflow pipe or passage 22, as the second orifice 62 and secondary electromagnetic valve 42 are open. Therefore, the injection pressure is more suppressed compared with the characteristic (broken line) in the case of the prior art, as shown in FIG. 2(*c*).

When the secondary electromagnetic valve 42 is perfectly closed in the state the main electromagnetic valve 41 is perfectly closed, the fuel injection pressure increases from the flat state, thus the suppression of the injection rate is released and the injection rate increases.

The main electromagnetic valve 41 and secondary electromagnetic valve 42 are then shifted from the closed state to the opened state and the fuel is returned to the fuel supply part 10 through the first orifice 61, main electromagnetic valve 49, the second orifice 62, and secondary electromagnetic valve 42. Therefore, the fuel injection pressure decreases, and the injection rate decreases to zero.

Figure 13:
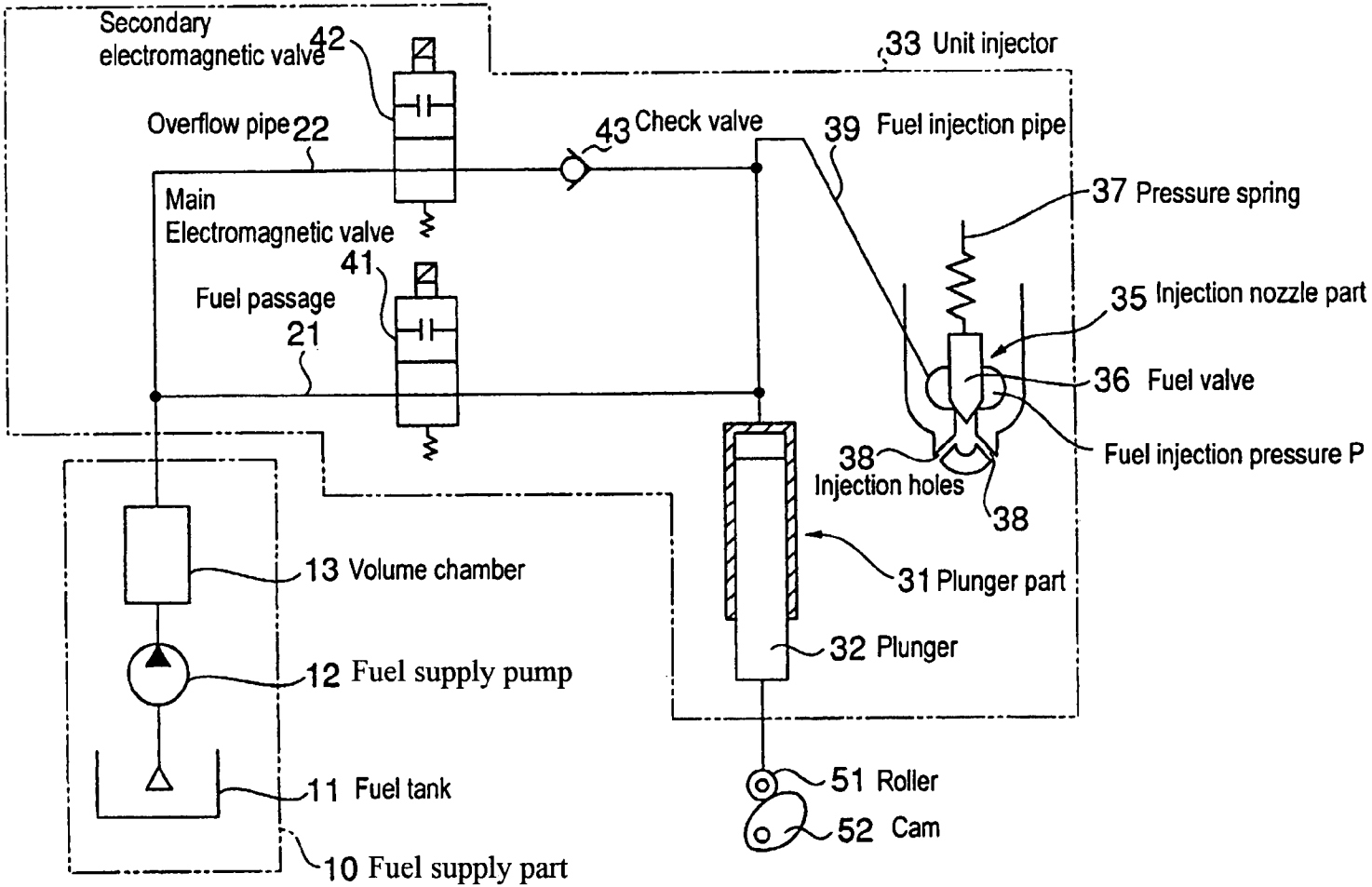
FIG. 13 a system diagram of the prior art corresponding to FIG. 1 of the present invention.
Figure 14A:
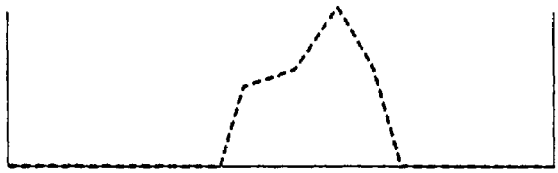
FIG. 14 is a representation showing the injection characteristics of the fuel injection equipment of prior art.
Figure 14B:
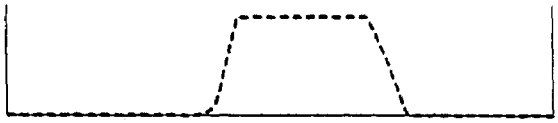
Figure 14C:
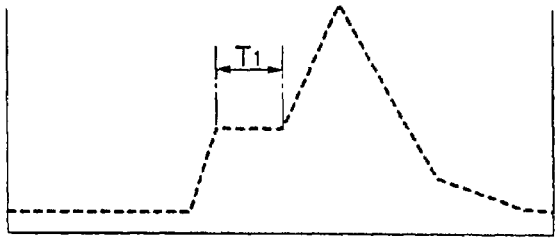
Figure 14D:
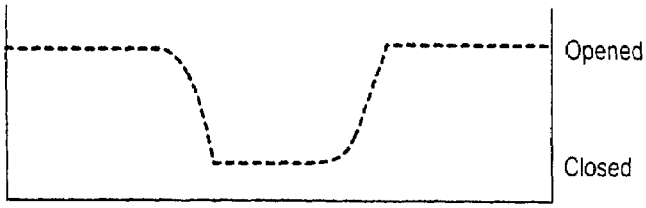
Figure 14E:
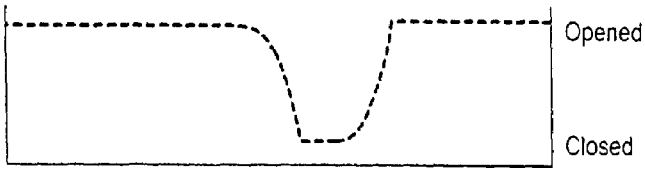
Figure 14F:
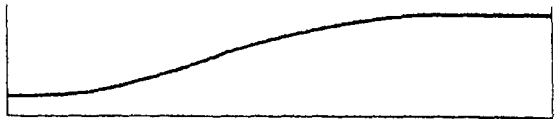

With the first and second embodiments, if the throttled flow passage areas of the main electromagnetic valve 41 and secondary electromagnetic valve 42, including the orifice 60*a* of variable opening area are determined on the larger side to suppress rapid combustion to keep the combustion temperature to a lower level and reduce the generation of nitrogen oxide (NOx) in the high speed (or high load) range of the engine operation, the injection pressure in the initial part of the fuel injection period decreases as shown with a chain line C in FIG. 13. This is because the throttled flow area is too large for the fuel quantity sent out from the plunger 32 in the initial period S, and satisfactory combustion is difficult to be attained resulting in deteriorated exhaust smoke and increased fuel consumption.

On the other hand, if the throttled flow passage areas are determined on the smaller side to evade the problem mentioned above and improve the combustion in the low speed (or low load) range, the injection pressure in the high speed(or high load) range is excessively increased and the maximum pressure in the cylinder is excessively elevated, resulting in the reduction of the durability of the constituent parts and the increase in the generation of nitrogen oxide (NOx).

In the third embodiment, as described before, the first orifice 61 is attached to the fuel passage 21 together with the main electromagnetic valve 41 (the orifice 61 may be integrated in the valve 41) and the second orifice 62 is attached to the overflow pipe or passage 22 together with the second electromagnetic valve 42 (the orifice 62 may be integrated in the valve 42), the throttled flow area of the orifices being different, and the action of the orifices are switched by the orifice switching apparatus 79, so the problem mentioned above is solved by the operation of the orifices as follows:

As shown in FIG. 11, the detected signal from the rotation speed detector 71 and the detected signal from the load detector 72 are input to the orifice throttle area calculating part 73 of the orifice control apparatus 70.

The orifice throttle area calculating part 73 calculates an orifice throttle flow area adequate for the detected engine rotation speed and load, and inputs the result to an orifice selecting part 76.

The orifice throttle area is determined to correspond to the engine speed (or load), and should be small for low engine speeds (or load) and increase with increasing engine speed (or load). The orifice throttle area calculating part 73 calculates (or selects) an adequate orifice throttle area for the detected values when engine speed and load are input thereto.

Reference numeral 74 is a throttle area setting part of the first orifice and the throttle area of the first orifice 61 is set therein. Reference numeral 75 is a throttle area setting part of the second orifice and the throttle area of the second orifice 62 is set therein.

These throttled flow areas of the first orifice 61 and second orifice 62 are determined to be different from each other as mentioned above, the throttled flow area of the throttle area setting part 74 for the first orifice 61 is determined to be large so as to be appropriate for the high speed (or high load) range of engine operation, and the throttled flow area of the throttle area setting part 75 for the second orifice 62 is determined to be small so as to be appropriate for the high speed(or high load) range of engine operation.

The areas may be determined so that the throttled flow area of the first orifice throttle area setting part 74 is small and that of the second orifice throttle area setting part 74 is large.

In said orifice selecting part 76, the calculated orifice throttle area corresponding to the detected engine load(or output) and speed is checked against the set value of the orifice throttle area setting part 74 of the first orifice and the orifice throttle area setting part 75 of the second orifice. The orifice which has a flow area that complies with the flow area calculated in the orifice throttle flow area calculating part 73 is then selected from either the first orifice 61 or second orifice 62.

When the calculated orifice throttle area is smaller than a certain value in the low engine speed(or low load), the second orifice throttle area setting part 75 in which a smaller flow area is determined is selected. When the calculated orifice throttle area is larger than a certain value in the high engine speed(or high load), the first orifice throttle area setting part 74 in which a smaller flow area is determined is selected.

The selection signal of the orifice selecting part 76 is output to the orifice switching apparatus 79. The orifice switching apparatus 79 allows the main electromagnetic valve 41 of the first orifice 61 side to open or the second electromagnetic valve 42 of the second orifice 62 side to open.

In the embodiment described above, the main electromagnetic valve 41 is opened, that is, the first orifice 61 having the larger throttled flow area works in the high engine speed range, and the injection pressure rises more gently, as shown with a solid line A in FIG. 12.

As a result, rapid combustion in the high speed (or high load) range of the engine operation is suppressed and the excess elevation of the maximum pressure and combustion pressure in the cylinder are prevented, resulting in the improved endurance of the constituent parts around the combustion chamber and reduction in the generation of nitrogen oxide(NOx).

In the low engine speed range, the secondary electromagnetic valve 42 is opened, that is, the second orifice 62 having the smaller throttled flow area works. Therefore, the amount of returning fuel is smaller for the fuel amount supplied by the plunger 32 in the initial part of the fuel injection, and the reduction in the injection pressure in the initial period S is prevented and a normal injection pressure mode is attained as shown with a solid line in FIG. 12.

As a result, the occurrence of insufficient combustion in the low engine speed(or low load) due to the reduced injection pressure is prevented and satisfactory combustion is attained, and the deterioration in exhaust smoke and increase in fuel consumption are prevented.

In the third embodiment, the first and second orifices 61, 62 are of fixed throttle areas. However, it is suitable to arrange the embodiment such that these orifices are of variable throttle area and their throttled flow areas are varied by the orifice switching apparatus 79 according to whether the engine is operating in the low speed (or low load) range or high speed (high load) range.

INDUSTRIAL APPLICABILITY

As has been described in the foregoing, according to claim 1 to 12, as an orifice of variable opening area is attached to an overflow pipe and a main electromagnetic valve and a secondary electromagnetic valve are controlled to open or close, the injection rate in the initial part of fuel injection period is further suppressed compared with the prior art, rapid injection of fuel into the cylinder in the initial period is prevented, resulting in further suppression of the fuel quantity injected in the initial period of the fuel injection.

As a result, since the rapid combustion of large amount of fuel in the initial part of injection period is prevented, the combustion temperature in the cylinder can be suppressed to a lower level resulting in further reduction in the generation of nitrogen oxide(NOx).

As the orifice of variable opening area has no movable part, it is durable without failure in use over a prolonged period, and mechanical reliability is high compared with a conventional check valve.

By adopting the orifice of variable opening area 60*a*, the quantity of the fuel returning through the overflow pipe or passage can be adjusted optimally.

By locating the orifice of variable opening area upstream from the secondary electromagnetic valve on the overflow pipe or passage in regard to the flow direction of the fuel returning from the unit injector, or by locating said orifice of variable opening area downstream from the secondary electromagnetic valve on the overflow pipe or passage in regard to the flow direction of the fuel returning from the unit injector, an arrangement optimal for the fuel injection equipment can be arbitrarily selected.

By composing the fuel injection equipment so that, the secondary electromagnetic valve has the closed position and a throttled open position, or it has the closed position, throttled open position, and opened position, the secondary electromagnetic valve effects throttling function without the necessity of providing an orifice of variable opening area, which contributes to simple fuel injection equipment.

According to the invention, the injection pressure rises more gently in the high speed range of the engine operation by allowing the orifice of larger flow area to work through the orifice control apparatus. By this, rapid combustion in the high speed range (or high load range) is suppressed, the elevation of the maximum pressure and combustion temperature in the cylinder is prevented, resulting in the improved endurance of the components around the combustion chamber and reduction in nitrogen oxide (NOx) emission. In the low speed range of the engine, the reduction in the injection pressure in the initial period is prevented by reducing the throttled flow area and reducing the returning fuel amount according to the fuel quantity sent out from the plunger part in the initial period of the fuel injection, and a proper injection pressure mode can be attained. By this, the occurrence of failed combustion due to reduced injection pressure in the low speed range of engine operation is prevented, and the deterioration in exhaust smoke and increase in fuel consumption are prevented.

The invention claimed is:

1. Fuel injection equipment comprising:

an injector comprising a plunger part, an injection nozzle part and a fuel injection passage for communicating between said plunger part and said injection nozzle part;

a fuel supply part for supplying fuel to said injector;

a fuel passage for communicating between said fuel supply part and said injector;

a main electromagnetic valve provided in said fuel passage;

an overflow passage for use in returning fuel not injected from said injector to said fuel supply part;

a secondary electromagnetic valve provided in said overflow passage; and an orifice of variable opening area provided in said overflow passage, said orifice and said second electromagnetic valve being operable to suppress a fuel injection pressure by the returning of the fuel through said overflow passage via said orifice and said secondary electromagnetic valve during a period from the time beginning when said main electromagnetic valve begins to shift from an opened state to a closed state and ending when said secondary electromagnetic valve is closed.

2. Fuel injection equipment comprising:

an injector comprising a plunger part, an injection nozzle part and a fuel injection passage for communicating between said plunger part and said injection nozzle part;

a fuel supply part for supplying fuel to said injector;

a fuel passage for communicating between said fuel supply part and said injector;

a main electromagnetic valve provided in said fuel passage;

an overflow passage for use in returning fuel not injected from said injector to said fuel supply part; and a secondary electromagnetic valve provided in said overflow passage;

wherein said secondary electromagnetic valve has a closed position, and a throttled open position, said secondary electromagnetic valve being operable to suppress a fuel injection pressure by returning the fuel through said overflow passage via said secondary electromagnetic valve and opening said secondary electromagnetic valve to the throttled open position during a period from the time beginning when said main electromagnetic valve begins to shift from an opened stated to a closed state and ending when said secondary electromagnetic valve is closed.

3. Fuel injection equipment comprising:

an injector comprising a plunger part, an injection nozzle part and a fuel injection passage for communicating between said plunger part and said injection nozzle part;

a fuel supply part for supplying fuel to said injector;

a fuel passage for communicating between said fuel supply part and said injector;

a main electromagnetic valve provided in said fuel passage;

an overflow passage for use in returning fuel not injected from said injector to said fuel supply part; and a secondary electromagnetic valve provided in said overflow passage;

wherein said secondary electromagnetic valve has a closed position, a throttled open position, and an open position, said secondary electromagnetic valve being operable to suppress a fuel injection pressure by the returning of the fuel through said overflow passage via said secondary electromagnetic valve with said secondary electromagnetic valve at the throttled open position during a period from the time beginning when said main electromagnetic valve begins to shift from an opened state to a closed state and ending when said secondary electromagnetic valve is closed.

* * * * *